US005201422A

United States Patent [19]

Ihara et al.

[11] Patent Number: 5,201,422

[45] Date of Patent: Apr. 13, 1993

[54] CLASSIFIER FOR POWDERY MATERIAL

[75] Inventors: Yoshitaka Ihara; Akira Ganse; Hidemasa Ishikawa; Takashi Katsurazako, all of Yao, Japan

[73] Assignee: Kubota Corporation, Osaka, Japan

[21] Appl. No.: 733,302

[22] Filed: Jul. 22, 1991

[30] Foreign Application Priority Data

Jul. 23, 1990 [JP] Japan ..... 2-196701

[51] Int. Cl.[5] ..... B04C 3/00

[52] U.S. Cl. ..... 209/144; 55/261; 55/393; 55/406; 209/139.2; 209/143; 209/145

[58] Field of Search ..... 209/142, 143, 144, 145, 209/154, 211, 139.2; 55/261, 393, 406

[56] References Cited

U.S. PATENT DOCUMENTS 4,094,772 6/1978 Hillekamp et al. ..... 209/144 X
4,211,641 7/1980 Jager ..... 209/144
4,260,478 4/1981 Hosokawa et al. ..... 209/144 X
4,285,707 8/1981 Pfenninger ..... 209/144 X
4,872,973 10/1989 Ikebuchi et al. ..... 209/144

FOREIGN PATENT DOCUMENTS 94615 7/1980 Japan ..... 55/406

*Primary Examiner*—Donald T. Hajec
*Attorney, Agent, or Firm*—Wenderoth, Lind & Ponack

[57] ABSTRACT

A classifier for powdery material has a cylindrical casing formed at an upper portion thereof with an inlet port for introducing the material to be classified into the casing in a tangential direction of an inner wall thereof. The casing has a conical portion formed in its bottom end with an opening connected to a discharge pipe for discharging coarse particles. Further, an outlet pipe protrudes into the casing through its top. The inlet port is located higher than the bottom end of the outlet port. An externally-driven vane wheel is provided under the outlet pipe in a concentric relationship with respect to the casing.

2 Claims, 3 Drawing Sheets

CLASSIFIER FOR POWDERY MATERIAL

BACKGROUND OF THE INVENTION

This invention relates to a classifier for classifying powdery material in gas according to their particle size and specific gravity.

FIG. 3 shows a prior art classifier of this type. It has a cylindrical casing 1 provided at the upper part thereof with an inlet port 2 for the material to be classified which extends in a tangential direction with respect to the inner wall of the casing. Material-air mixture a is fed into the casing 1 through the inlet port 2 casing. Coarse particles are classified by the cyclone casing. Coarse particles are classified by the cyclone effect due to the vortex.

An externally driven vane wheel 3 is mounted in the upper part of the casing 1. It serves to blow off any unclassified coarse particles going toward an outlet port 7 by imparting a centrifugal force thereto, thereby separating any fine particles. Thus it serves to improve the classifying effect. The material-air mixture thus classified flows out of the casing through the outlet port 7 and is collected in a collector (not shown) such as a bag filter.

A gas (air) inlet port 4 is formed in the lower part of the casing 1. Air b fed into the casing 1 through the inlet port 4 forms an upward vortex by spinning vanes 5 (see FIG. 2*d*). The upward air current b separates any fine particles from the coarse particles and flows out through the outlet port 7 together with the separated fine particles.

The coarse particles c thus classified are discharged through a discharge port 6 formed in the bottom of the casing 1.

The vane wheel 3 comprises an inverted conical member 3*a* at its bottom, a disc 3*b* formed with a through hole and a plurality of vanes 3*c* provided between the conical member 3*a* and the disc 3*b* and arranged at equal angular intervals from one another.

In this type of apparatus, since the inlet port 2 and the vane wheel 3 are located on the same level as is apparent from FIG. 3, the material-air mixture a tends to reach the vane wheel 3 without sufficiently undergoing the cyclone effect. Thus, the density of the material-air mixture a is high, i.e. the air contains large amounts of coarse particles when it reaches the vane wheel 3. As a result, the vane wheel 3 suffers from a large load and gets worn rather severely. Also, the higher the density of the mixture, the lower the accuracy of classification and the more easily the coarse particles flow out through the outlet port 7.

SUMMARY OF THE INVENTION

An object of this invention is to provide a classifier in which the classification by the vane wheel can be carried out in a low-density condition.

In accordance with the present invention, an outlet pipe is provided so as to protrude into the casing through its top and an externally-driven vane wheel is provided under the outlet pipe in a concentric relationship with respect to the casing. An inlet port for introducing the material to be classified and air mixture (hereinafter referred to as the material-air mixture) in a tangential direction is provided at a higher level than the bottom end of the outlet pipe.

An inlet for air is provided at a lower level than said vane wheel to introduce air into the casing in the same tangential direction as the tangential direction in which the material to be classified is introduced. A conical member is provided adjacent to the inlet for introducing air.

A cylindrical body is provided between the inner wall of the casing and the vane wheel at predetermined distances from the casing and the vane wheel. It has at its top a small-diameter portion. The abovesaid distances and the diameter of the small-diameter portion are suitably determined, taking the classification efficiency into consideration. The vertical position of the cylindrical body is adjustable.

According to this invention, the material-air mixture is introduced into the casing through the inlet port with the vane wheel in rotation. The mixture flows in a tangential direction with respect to the inner wall of the casing and goes down in a vortex around the outlet pipe. Coarse particles in the material are classified by the cyclone effect on the downward vortex and flow down along the inner wall of the casing and are discharged through the discharge pipe.

When the mixture reaches the vane wheel, any remaining coarse particles are scattered outwardly by the centrifugal force applied by the rotation of the vane wheel. At the same time, fine particles adhering to the coarse particles are disengaged. The mixture thus reclassified and which contains only fine particles is fed into the outlet pipe through its bottom opening and is processed (collected) in the next step.

Since the inlet port for the material is located higher than the bottom opening of the outlet pipe, the mixture flows down whirling round for the length of the outlet pipe until it reaches the vane wheel and thus can be classified sufficiently by the cyclone effect. Namely, the vane wheel is subjected to a mixture of a lower density than is the prior art vane wheel.

By providing the inlet ports for gas in the lower part of the casing, falling coarse particles can be reclassified in the same manner as with the prior art. Further, by the provision of the conical member, the gas introduced through the inlet port can be smoothly put into a whirling motion. This improves the classification efficiency.

The cylindrical body may be mounted around the vane wheel with its top end reduced in diameter so as to be sufficiently close to the outer periphery of the vane wheel. It serves to divide the vane wheel into upper and lower parts and the space between the vane wheel and the inner wall of the casing into two parts. Thus, the current carrying fine particles scarcely mixes with the downward flow of coarse particles, because although the coarse particles classified by the cyclone effect tend to go toward the center of the casing as they fall, they are blocked by the cylindrical body.

The current carrying fine particles formed by the cyclone effect enters, in the form of a laminar flow, the top part of the vane wheel and is classified. Then it flows out through the outlet pipe.

Since inward flow of the coarse particles is blocked by the cylindrical body, they are guided along the cylindrical body toward the inner wall of the casing, where they are classified by contact with the whirling current from the inlet ports. The current carrying fine particles reaches the vane wheel and is classified. Then it flows out through the outlet pipe.

By moving the cylindrical body up and down, the area ratio between the two passages leading to the outlet pipe, i.e. the passage formed at the portion of the vane wheel not surrounded by the cylindrical body and the passage formed at its surrounded portion is adjustable. Thus, the particle size of classification is adjustable.

According to this invention, even if a high-density mixture is used, the vane wheel experiences a low-density condition by providing the outlet pipe in the casing. Thus, the material can be classified with high accuracy and the vanes are protected against wear.

Also, by the addition of the inlet ports at the lower part of the casing, and of the conical member and the cylindrical body, more accurate classification becomes possible. Further, by moving the cylindrical body up and down, the classification size can be changed.

BRIEF DESCRIPTION OF THE DRAWINGS

Other features and objects of the present invention will become apparent from the following description taken with reference to the accompanying drawings, in which.

DETAILED DESCRIPTION OF THE PREFERRED EMBODIMENTS

Figure 1:
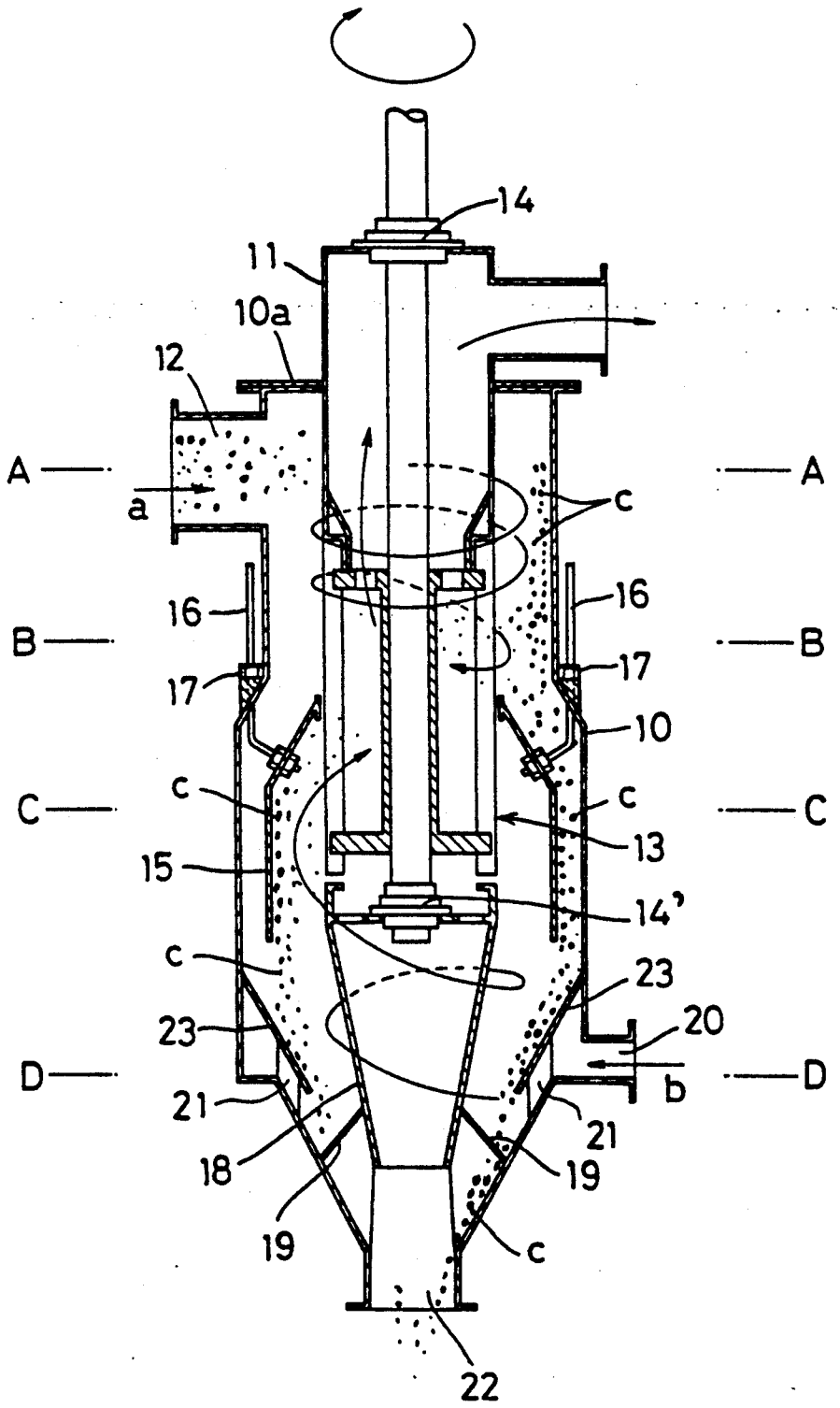
FIG. 1 is a schematic sectional view of one embodiment of the classifier according to this invention.

As shown in FIG. 1, a cylindrical casing 10 has its top closed by a top plate 10*a*. An outlet pipe 11 for discharging air containing fine particles extends through the center of the top plate 10*a* and protrudes into the casing 10. An inlet port 12 for air mixed with the material to be classified is provided at the top end of the casing 10.

Figure 2:
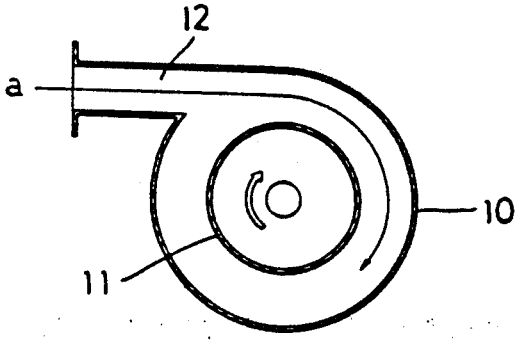
FIGS. 2*a*–2*d* are sectional views taken along lines A—A, B—B, C—C and D—D in FIG. 1, respectively.
Figure 2:
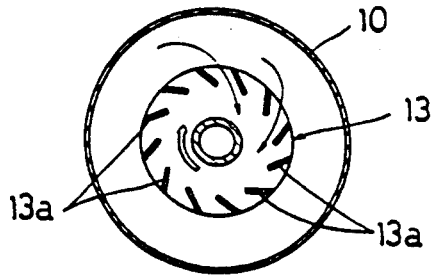
Figure 2:
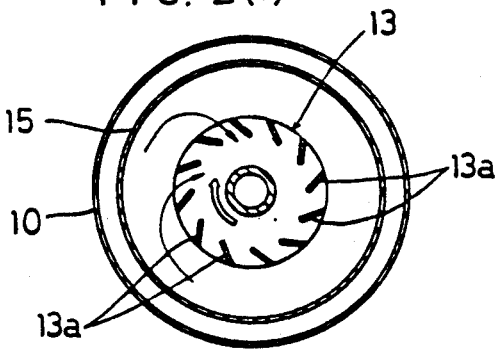
Figure 2:
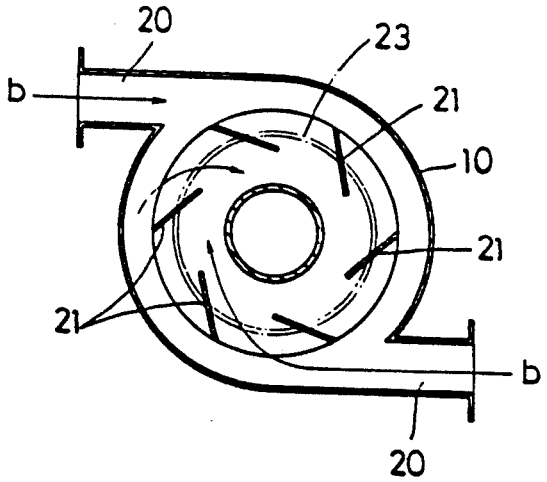
Figure 3:
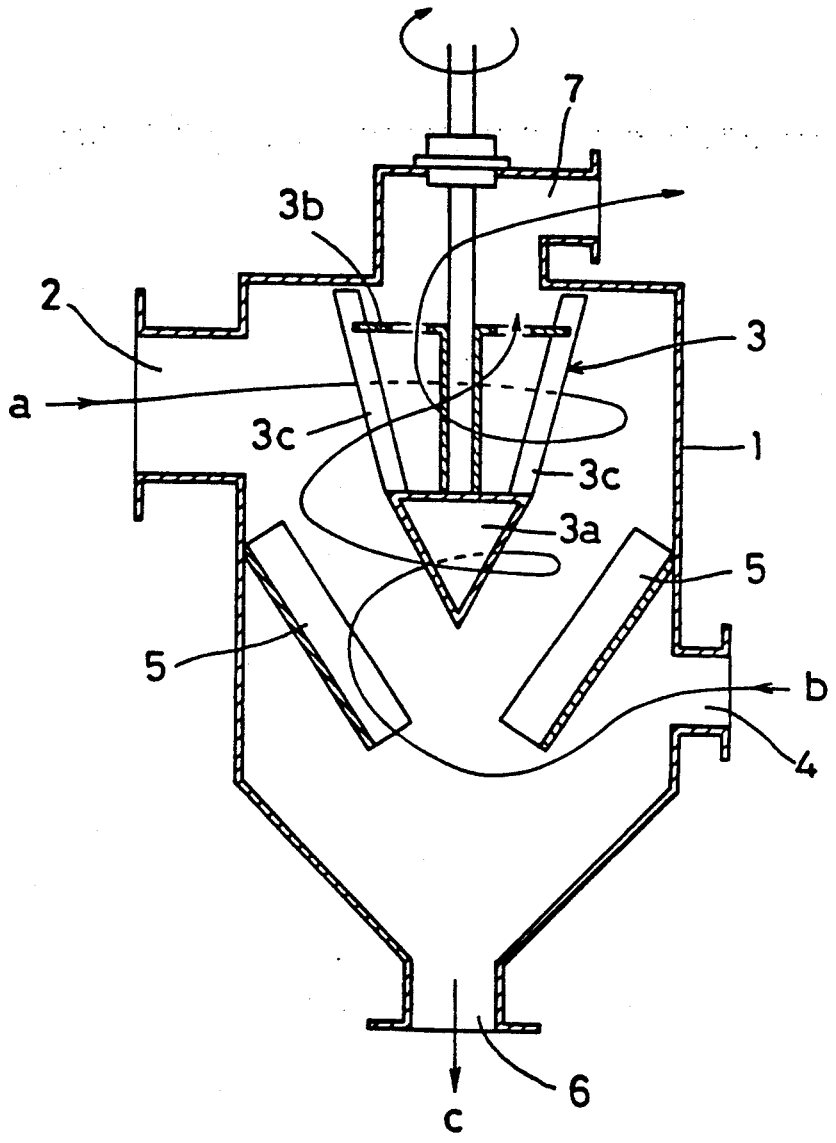
FIG. 3 PRIOR ART
FIG. 3 is a schematic sectional view of a prior art classifier.

A vane wheel 13 is provided under the outlet pipe 11 and is rotatably supported by a bearing 14 provided on top of of the outlet pipe 11 and a bearing 14' provided on top of a conical tube 18 (described later). It is driven by an external motor. Its turning speed is suitably determined taking into account the classifying efficiency. As shown in FIGS. 2*b* and 2*c*, the vane wheel 13 has a plurality of vanes 13*a* arranged at angularly equal intervals and each extending obliquely inwards with respect to the direction of rotation. When the vane wheel 13 rotates, the particles will touch the vanes 13*a* and be driven obliquely outward by the skewed surfaces of the vanes. Namely, they are classified by centrifugal force.

A cylindrical body 15 is provided to partially surround the vane wheel 13 and is fixed in position to the casing 10 by three threaded shafts 16 arranged at equal angular intervals. By turning their nuts 17, the threaded shafts 16 can be moved up and down together with the cylindrical body 15.

Conical tubes 18 and 23 are provided under the vane wheel 13 and are supported by arms 19 and vanes 21 (described later), respectively. The casing 10 has two air inlet ports 20 at the lower part thereof. As shown in FIG. 2*d*, they are provided at diametrically opposite positions and extend in a tangential direction with respect to the inner wall of the casing 10 through the inlet ports 20, a vortex is formed in the casing. As shown in FIG. 2*d*, spinning vanes 21 are provided in the casing 10 to face the inlet ports 20. The vanes 21 and the conical tube 23 contribute to a smooth formation of vortex.

The casing 10 has an inverted conical bottom portion and is formed in the bottom end thereof with a discharge port 22 for discharging the coarse particles. A discharge pipe (not shown) is connected to the discharge port 22.

In operation, when the material-air mixture a is introduced into the casing 10 through the inlet port 12 with the vane wheel 13 in rotation, the mixture flows in a tangential direction with respect to the inner wall of the casing 10 and moves down around the outlet pipe 11 in a downward vortex. Coarse particles c in the material-air mixture a are classified by the cyclone effect due to the downward vortex and sink down along the inner wall of casing 10 as guided by the cylindrical body 15.

While the material-air mixture a flows down along the outlet pipe 11, it undergoes a sufficient cyclone effect until it reaches the vane wheel 13, whereupon any remaining coarse particles c are scattered outwardly by the centrifugal force due to the rotation of the vane wheel 13. At the same time, fine particles adhering to the coarse particles are disengaged therefrom. The material-air mixture a thus reclassified and containing only fine particles flows up into the outlet pipe 11 through its bottom opening and is sent to the next piece of equipment such as a bag filter.

On the other hand, the classified coarse particles c flow down as guided by the cylindrical body 15 and the conical tube 23. On their way down, fine particles adhering thereto are disengaged by the cyclone effect due to the vortex of air flowing into the casing 10 through the inlet ports 20. The vortex carrying the fine particles reaches the vane wheel 13 and is classified thereby. Then it flows out of the casing 10 through the outlet pipe 11.

The degree of classification is adjusted by changing the height of the cylindrical body 15 and thus the area of the vane wheel 13 surrounded by the body 15. Namely, when the body 15 is raised, the area of the vane wheel 13 not surrounded by the cylindrical body 15 decreases, thus narrowing the sectional area of the passage through which the material-air mixture a can flow into the outlet pipe 11. This will speed up the flow of the mixture a. Thus the coarse particles tend to be carried by the mixture a. When the body 15 is lowered, the area of the passage for the mixture expands, thus decreasing the flow speed. This will reduce the tendency to carry the coarse particles, reducing the size of classification.

The flow rate of air through the air inlet ports 20 has to be changed according to the area of the vane wheel 13 surrounded by the cylindrical body 15, i.e. the area of passage leading to the outlet pipe 11. Namely, the flow rate of air has to be adjusted so that the classification size at the lower part of the vane wheel 13 surrounded by the body 15 is equal to the classification size at its upper part not covered by the body 15.

Thus, the classification size can be changed by adjusting the height of the cylindrical body 15, the flow rate of air through the air inlet ports 20 and the revolving speed of the vane wheel 13.

In the embodiment, classification is carried out by use of air. But any other gas or a liquid such as water may be used instead.

What is claimed is:

1. A classifier for classifying powdery material, said classifier comprising: a casing including a cylindrical side wall, a material inlet port extending tangentially to said cylindrical wall and open to the interior of said casing at an upper portion of said casing such that material to be classified can be introduced into said casing through said material inlet port, an inverted conical bottom defining a discharge port through which coarse particles are to be discharged, and a fluid inlet port extending tangentially to said cylindrical wall in substantially the same direction as said material inlet port and open to the interior of said casing at a lower portion of said casing such that a fluid can be introduced into said casing through said fluid inlet port; a conical tube disposed within said casing adjacent the location where said fluid inlet port is open to the interior of said casing; an outlet pipe protruding into said casing from the top of said casing and terminating at a bottom end thereof within said casing, said material inlet port being open to the interior of said casing at a location that is higher in the classifier than the bottom end of said outlet pipe; an externally-driven vane wheel rotatably supported in said casing about the central longitudinal axis of the cylindrical side wall of said casing so as to be disposed in a concentric relationship with said casing, said vane wheel being disposed under said outlet pipe and above the location where said fluid inlet port is open to the interior of said casing; and a cylindrical body interposed between said vane wheel and the cylindrical side wall of said casing and spaced at predetermined distances therefrom, respectively, said cylindrical body having a top portion of a smaller diameter than the remaining portion thereof, the top portion of said cylindrical body extending around said vane wheel proximate the outer periphery thereof thereby surrounding only a lower portion of said vane wheel while leaving uncovered a portion of said vane wheel located between the top portion of said cylindrical body and the bottom end of said outlet pipe.

2. A classifier as claimed in claim 1, and further comprising an adjustable support connected to said cylindrical body, said cylindrical body being vertically movable to respective positions in said casing by the adjustment of said support.

* * * * *